United States Patent [19]

Nitzberg

[11] 4,438,699

[45] Mar. 27, 1984

[54] METHOD FOR REMOTE POSITIONING OF EXPLOSIVE CHARGES IN MINING VOIDS

[75] Inventor: Leonard R. Nitzberg, Knoxville, Tenn.

[73] Assignee: Patent Development Ltd., Knoxville, Tenn.

[21] Appl. No.: 193,927

[22] Filed: Oct. 6, 1980

[51] Int. Cl.[3] ..... F42B 3/00

[52] U.S. Cl. ..... 102/313; 102/312; 102/275.7; 102/320; 102/275.12; 299/13; 166/50

[58] Field of Search ..... 102/313, 312, 319, 320, 102/275.7, 275.12; 86/20 C; 299/13; 166/299, 50

[56] References Cited

U.S. PATENT DOCUMENTS

| | | | |
|---|---|---|---|
| 2,893,285 | 7/1959 | Payne | 102/313 X |
| 3,104,584 | 9/1963 | Jacobs | 102/313 X |
| 3,648,612 | 3/1972 | Grayson | 102/319 |
| 3,949,673 | 4/1976 | Lyerly | 86/20 C X |
| 4,002,119 | 1/1977 | Halley, Jr. | 102/313 |
| 4,282,812 | 8/1981 | Forgey et al. | 102/320 X |

*Primary Examiner*—Peter A. Nelson

*Attorney, Agent, or Firm*—Pitts, Ruderman & Kesterson

[57] ABSTRACT

Method and apparatus for remotely positioning individual explosive charges at preselected locations in substantially horizontal voids created by mining hard material such as coal are disclosed. The method includes the steps of positioning at least one charge proximate the entry of a void. The charge is then armed as by connecting a detonator cord thereto and inserted into a void to a preselected depth from a remote location. An apparatus is provided for positioning the charges at preselected locations in the voids and includes insert means having a body member for releasably engaging the charges during the positioning operation. The insert means is driven until the body member and charge propelled thereby is moved to a preselected location within the void where the charge is deposited.

10 Claims, 12 Drawing Figures

METHOD FOR REMOTE POSITIONING OF EXPLOSIVE CHARGES IN MINING VOIDS

BACKGROUND OF THE INVENTION

This invention relates to mining site reclamation and more particularly concerns a method and apparatus for remotely placing explosive charges in mining voids such as auger holes preparatory to detonation for reclamation purposes.

Recent developments in blasting technology have provided the mining and similar industries with techniques for highwall demolition and spoil creation. The techniques use directional and nondirectional charges placed in voids created by mining which are substantially horizontally disposed. The voids can have various and cross-sectional outlines, for example the cross-sectional geometry can be circular, rectangular or oval depending on the mining method creating the void. The voids commence at an entry proximate the cropping of an ore vein and continue inwardly to the depth at which the mining operation ceased. Certain reclamation techniques require the placement of armed individual charges at specific locations in the voids such as auger holes and drift mine shafts. Placement of the charges at specific locations enhances the efficiency of the blast and reduces the cost of demolition and reclamation.

Statuary limitations prevent the entry of personnel into certain classes of voids such as auger holes. Additionally, auger holes, and other types of voids, though substantially horizontal, can slope downward from the entry and may be flooded. This would prevent access by personnel to the void depths for purposes of placing charges for safety reasons.

In certain embodiments of demolition techniques each void is loaded with a plurality of charges. To reduce seismic impact and maximize efficiency the charges to be detonated are fired at specific delayed time intervals. These delays may be only a few hundred nanoseconds. An effective method of producing such small delays is to sequentially attach the charges by means of a detonator cord branch line to a detonator cord trunk line. To insure the positive ignition of the branches of the detonating trunk line, a positive contact cord-to-cord would normally be employed. Contact would be insured by knotting the cords securely or by some similar technique. This form of attachment would however make remote placement difficult.

OBJECTS OF THE INVENTION

Accordingly, it is an object of the present invention to provide a method and apparatus for the remote placement of individual explosive charges at preselected locations in auger holes. Another object of the invention is to provide a portable apparatus for the remote placement of charges in mining voids which can be power driven. Still another object of the invention is to provide a means for attaching detonator cords which can be slidingly deployed along a detonator cord trunk line to the point of use. Yet another object of the invention is to provide means for carrying the charges to preselected locations in the mining void in a manner which prevents the charges from contacting and being damaged by the void walls. Other objects and advantages of the invention will become apparent upon reading the following detailed description together with the drawings which are described as follows:

SUMMARY OF THE INVENTION

Figure 1:
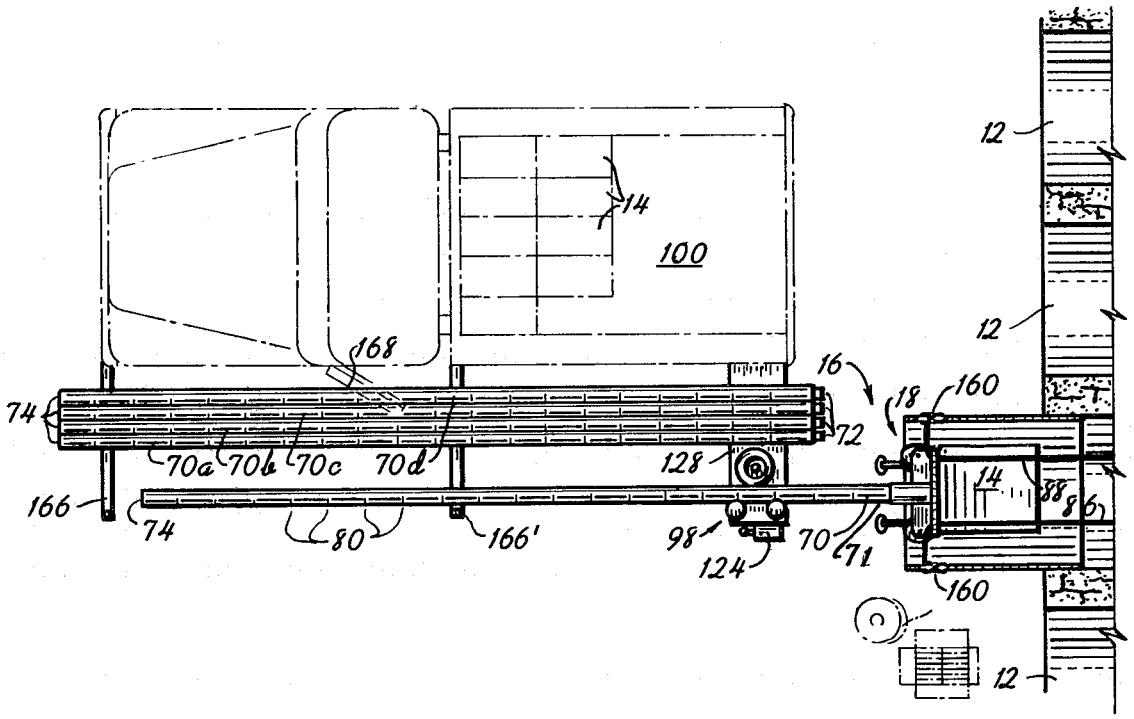
FIG. 1 is a plan view partially in section of a mining site at which an explosive charge is being inserted into a void such as an auger hole by a method and apparatus employing various features of the present invention.

In accordance with the illustrated embodiment of the invention a method for remotely positioning individual explosive charges at a preselected locations within a mining void is disclosed. The method enables the remote loading of explosive charges in uninhabitable voids such as auger holes or drift mine passages which are substantially horizontally disposed in a partially mined seam of ore. The voids originate at an entry proximate the cropping of the ore vein and continue inwardly to the location at which the mining operation ceased. The method includes the steps of placing an explosive charge proximate the entry of a void into which it is to be loaded. The charge is armed usually by connecting a detonator cord, or cords, to the charge. The charge is then contacted by an inserting means and thrust into the void to a preselected depth. The inserting means is then withdrawn and another charge can be placed proximate the void. Successive charges are armed by means of a slidingly attachable detonator cord connection which is affixed at a position remote to the void. The connection joins the detonator cord of the individual charge to the detonator cord trunk line. It is then propelled slidingly together with the charge to the preselected location. Successively armed charges are contacted and inserted into the voids to preselected locations. The charges can be positioned proximate the entry of the void, and in alignment therewith in an open topped charge loading platform prior to being thrust into the void. The platform is suitable for top loading heavy charges or for field construction of charges from blasting constituents such as, dynamite, detonator cord and blasting agent.

An apparatus for carrying out the method of the present invention is provided and serves to position the explosive charges at preselected locations in voids created by mining in a vein of ore. The machine includes charge insert means having a body member which contacts the charge during the positioning operation. The body member is connected with driving means which propel the body member into the void from a remote location. In one embodiment, the body member contains wheels or skids to reduce frictional load during the charge positioning operation. In a further embodiment the apparatus includes driving means having extendable and calibrated arms which can be joined at their juxtaposed end portions to increase the effective length of the driving means and accordingly increase the depth at which the charges can be placed in the voids. Moreover, these arms may be used to rotatably orient the charge during placement as well as provide an indication of the depth of insertion. In one embodiment insertion and retraction of the driving means is powered by a portably mounted hydraulic motor which is suitable for being mounted on a motor vehicle and being powered by said vehicle. The hydraulically powered motor is connected to and propels the driving means through a mechanical coupling in a preselected direction.

A device is also provided which couples or connects two or more detonator cords in detonating proximity and which can be slidingly positioned along one of the cords after attachment. More specifically, the device defines a substantially toroidal cross-section outline and includes a bore through which one or more detonator cords can be passed and through which one or more detonation cords can be slidably received. The explosive ignition of any cord within the confines of the body member ignites by brisance the other detonator cord, or cords, within the same body member.

DESCRIPTION OF THE PREFERRED EMBODIMENT

Referring now the drawings, an apparatus for positioning explosive charges at preselected locations in voids created by mining in a vein of ore such as coal, is illustrated generally at 10 in FIG. 1. The apparatus is particularly suited for inserting explosive charges into substantially horizontal voids having various geometric outlines. For example, the voids may have circular or oval cross-sectional outlines if formed by augers or the voids may have rectangular or elongated oval cross-sectional outlines as in the case of drift mine passages. The voids commence at an entry positioned at the cropping of the seam of ore and extend substantially horizontally into the ore seam and terminate at the location of the cessation of the mining operation. Normally, the voids are uninhabitable by reason of government mandate or for reasons of safety, for example it is quite common for the voids to be flooded. Accordingly, it is desirable and in some cases required by government agencies for the voids and proximate mining site to be reclaimed, both for purposes of eliminating safety hazards and for purposes of environmental reconstruction. To this end, one method of reclaiming the mining site involves the placement of spaced charges within the voids, detonating the charges and then grading and/or planting vegetation proximate the rubble and collapsed voids. It has been found that this method of reclamation is both inexpensive and poses minimal safety hazards to the reclamation personnel provided the explosive charges can be remotely placed at preselected locations with the voids.

The charges placed within voids are normally attached to a blasting cap which can be ignited by an electrical impulse or a detonator cord, which is a strong flexible cord containing a core of detonating explosive. In reclamation operations employing a detonator cord as the blast initiator, the first charge inserted into a selected void is connected to the detonator cords which serve as blasting trunk lines that extend from the entry of the void to the deepest charge therein. Subsequent charges are primed by attaching a sliding detonator cord branch line to each of the charges. This branch line or detonator cord is then attached to the main blasting or trunk line prior to the insertion of the charge. The charge is then inserted into the void to a desired depth with the detonator cord branch line providing the igniting connection between the charge and the main blasting or trunk line.

The apparatus of the present invention which is adapted for positioning the explosive charges at preselected locations in the voids includes charge insert means which is adapted for engaging and moving the explosive charges sequentially to preselected locations within the voids. The illustrated charge insert means 16 includes a body member 18 having a cross-sectional outline proportioned for movement along the longitudinal axis of the voids 12. The body member 18 illustrated in FIGS. 3 and 5 includes a substantially planar contacting face 20 which is suitable for engaging and propelling a charge 14 into the void. While the illustrated body member is substantially rectangular in outline, it will be recognized by those skilled in the art that the particular configuration of the body member can assume various geometries.

Figure 7:
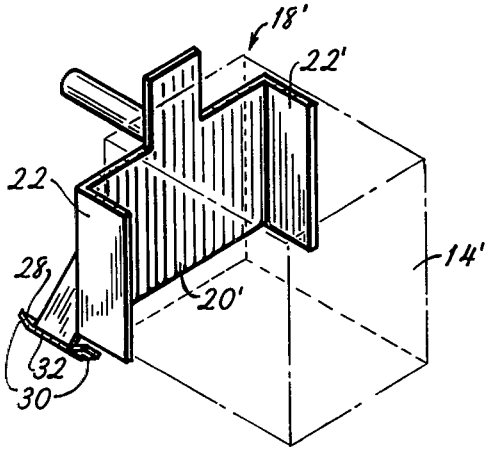
FIG. 7 is an isometric view of an alternate embodiment of the body member of charge insert means.

In certain charge placement operations, it is desirable for the orientation of the charge to be controlled during its movement along the length of the void. To this end, the body member 18' illustrated in FIG. 7 includes means for preventing rotation of the charge with respect to the body member 18' during charge placement. More specifically, the body member 18' includes projections 22 and 22' which are proportioned for receiving the end portion of the charge such that the charge cannot rotate during the placement of the operation.

The charge insert means 16 is connected with the driving means generally indicated at 98 which serves to move the body member 18 into the void for placement of the charge and out of the void for removal of the body member subsequent to the charge placement. The illustrated driving means includes at least one arm 70 or section and as shown in FIG. 1, a plurality of extension arms 70 are provided. Each of the extension arms includes a male end portion 72 which is connected with a juxtaposed female end portion 74 of an adjacent extension arm. The extension arms can be sequentially connected for propelling the charge into a void to preselected depths. It will be recognized that the charge can be placed within the void to a depth substantially equal to the effective length of the driving means extension arms as they are connected in their end to end relationship.

Figure 6:
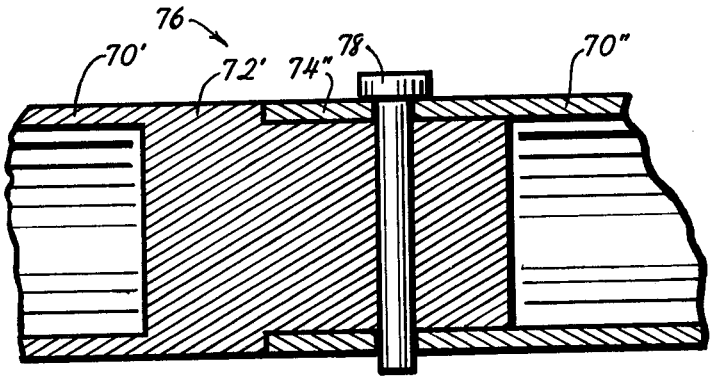
FIG. 6 is an elevation view in section showing the coupling of joined sections or arms of the insert means.

The juxtaposed end portions of the arms are connected as illustrated at 76 in FIG. 6. More specifically, a male end 72' of the extension arm 70' is inserted into the female end portion 74' of the juxtaposed extension arm 70''. A pinning mechanism 78 extends through each of the connected extension arms to secure the arms together and prevents rotation of one extension arm with respect to the other. It will be recognized by those skilled in the art that the cross-sectional outline of the extension arms 70 may assume various geometries. For example, the cross-sectional outline may be circular, rectangular, or any other desired shape.

Figure 5:
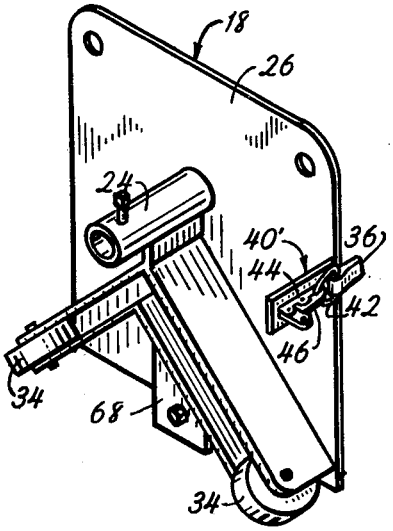
FIG. 5 is an isometric view of one embodiment of the body member of the charge insert means.

In order to place the charges at preselected depths, the extension arms in one embodiment are provided with calibrations 80 which indicate specified length measurements with indicia marked on the surface of the extension arms. Thus, an operator can observe the indicia on the extension arms as they are joined and propelled collectively into the void and note the depth at which the explosives are placed. The leading end portion 71 of the extension arm 70 is releasably attached to the body member such that movement of the extension arms in a forward or a reverse direction along the length of the void imparts a concomitant motion to the body member. In this regard, an attachment means 24 is positioned on the back 26 of the body member 18 and is proportioned for receiving the end portion 71 of the extension arm 70 therein. The attachment means 24 is preferably located proximate the center of gravity of the explosive charge propelled by the body member to assist in preventing movement of the charge and body member in a direction perpendicular to the longitudinal axis of the void during the placement operation. A set screw as illustrated in FIG. 5 can be provided on the attachment means 24 to assist in preventing the body member and the leading end portion of the extension arm 70 from becoming disengaged during the outward motion of the extension arms.

In order to facilitate movement of the body member along the lower surface of the void, friction reduction means are mounted proximate the lower portion of the body member. While it will be recognized by those skilled in the art, that the friction reduction means can take various embodiments, in the embodiment illustrated in FIG. 7 skids 28 are provided which include sloped forward and rearward portions 30 which facilitate movement of the skids over obstacles on the void floor during the insertion and extraction operations. Preferably, the skids are mounted in pairs on the opposite sides of the body member and each skid is provided with a sliding surface 32 which contacts the floor and/or wall of the void during movement of the driving means. In the embodiment illustrated in FIG. 5, wheels 34 serve as the friction reduction means and reduce the liklihood of binding the body member during the insertion or extraction operation, and also serve to reduce the power required to move the body member.

Figure 3:
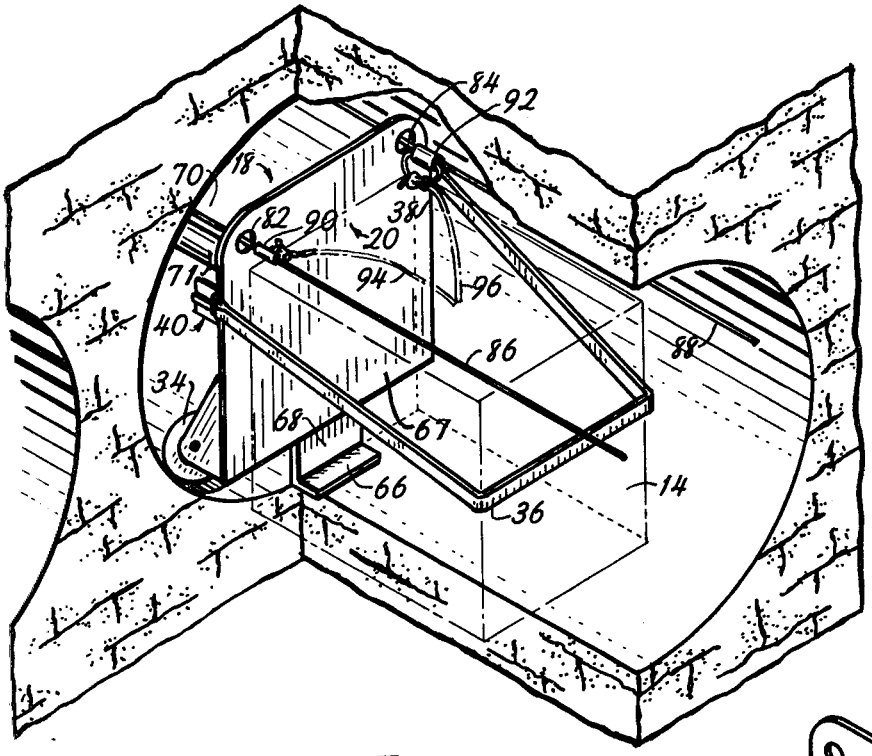
FIG. 3 is an isometric view in section depicting a charge being inserted into an auger hole by exemplary charge insert means.
Figure 4:
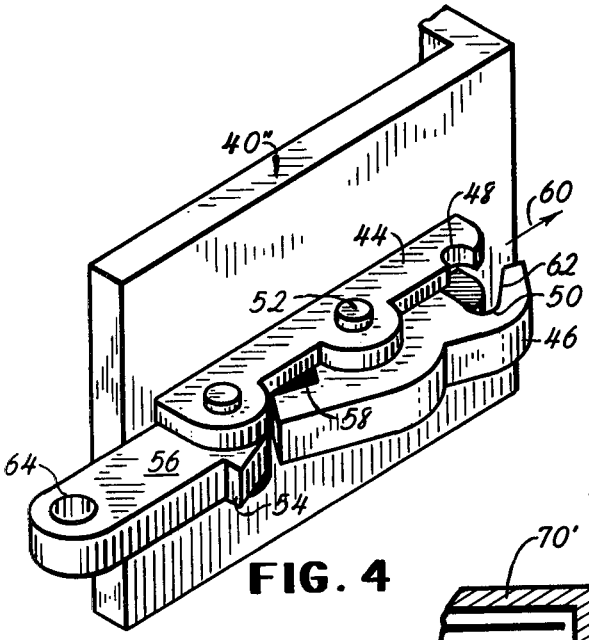
FIG. 4 is an isometric view of a portion of means for releasably attaching a charge insert means.

In certain charge placement operation, it is desirable to releasably attach the charge to the body member as, for example, to retract the charge if the body member is thrust inadvertently to a greater than desired depth within the void. In this connection, the body member 18 is illustrated in FIG. 3 is equipped with means generally indicated at 35 which serve to releasably attach the charge to the body member. More specifically, the attachment means 35 includes an elastic retaining member 36 which is anchored to the body member at the location indicated at 38. The elastic retaining member circumscribes the sides of explosive charge and is secured at its opposite end to the body member by the retaining member 38. This retaining member can be remotely operated by a release mechanism 40 which is shown in a secured or attached position at 40' in FIG. 5 and in the released position 40'' in FIG. 4. In the attached position 40' illustrated in FIG. 5, the elastic retaining member 36 terminates at a "D" ring 42 which is held in a space defined between the retaining body member 44 and a clasp 46. This space is defined by notches 48 and 50 in FIG. 4 in the retaining body member 44 and the clasp 46, respectively. The release mechanism is closed when the clasp 46 is rotated about the hinge pin 52 with the "D" ring positioned within the space defined by the notches 48 and 50. The release trigger 56 includes a tang 54 which is locked behind the sear portion 58 of the clasp 46 to secure the rotational position of the clasp. The contraction forces of the retaining member 36 act in a direction 60 thereby securing the release mechanism in its locked position. More specifically, the contraction of the retaining member serves to move the "D" ring in a direction against the sloped camming surface 62 and creates pressure between the clasp 46 and the tang 54 which frictionally maintains the clasp in its locked position. The trigger 56 is provided with a bore 64 which receives an end portion of a cord or lanyard (not shown). When the opposite end of the cord is pulled from a remote location external to the void, the trigger 56 is moved to the location indicated in FIG. 4 thereby unlocking the sear 58 and releasing the "D" ring 42 attached to the elastic retaining member. Thus, the charge secured to the face of the body member by the release mechanism is released at a preselected location within the void.

In certain applications where the means 35 is provided for releasably securing the charge to the body member 18, it is desirable to mount the charge on the body member such that it does not contact the bounds of the void during charge placement procedures. In this connection, a charge support 68 is provided as illustrated in FIG. 3 which defines a lip 66 which supportably engages the lower portion of the charge. The position of the lip 66 can be adjusted with respect to the lower edge 67 of the body member 18 as by the screws illustrated in FIG. 5 on the backside of the support member 68. By supporting the charge with the support 68 and the attachment means 35, the charge can be moved into the void to a preselected depth without contacting or damaging the charge packaging.

Figure 10:
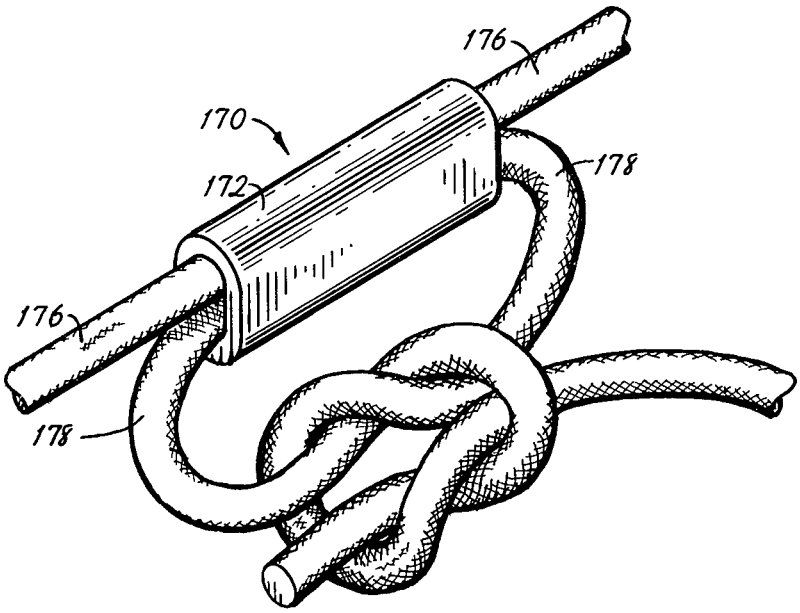
FIG. 10 is an isometric view of a device for slidably connecting and maintaining a detonator cord and a detonator cord trunk line in igniting proximity.
Figure 11:
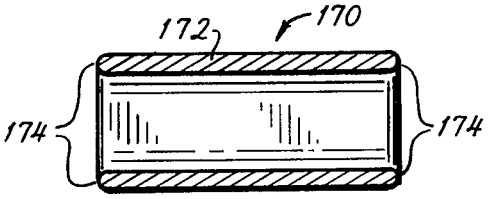
FIG. 11 is a side elevation view in section of the detonation cord connecting device illustrated in FIG. 10.
Figure 12:
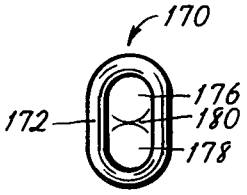
FIG. 12 is an end elevation view of the detonation cord attachment device illustrated in FIGS. 10 and 11.

The detonator cord connectors or device for maintaining two or more detonator cords interfaced in detonating proximity is illustrated at 170 in FIGS. 10, 11, and 12. This connector device is suitable for coupling two or more detonator cords and can be slidingly positioned along one of the cords subsequent to attachment. More specifically, the device 170 includes a body member 172 which defines a substantially toroidal cross-sectional outline having an opening extending therethrough. This opening receives one or more detonator cords in sliding relationship. More specifically, during the charge placement a trunk line 176 extends from a location external to the void, through the void and to the charge placed at the farthest location within the void depth. The connector 170 serves to join the trunk line with individual detonator or branch cords 178. As illustrated in FIG. 10 the detonator cord 178 is secured as by tying it about the body member 172 such that movement of the connector 170 along the length of the trunk line causes the detonator cord 178 to move with the connector. During this motion the detonator cord 178 is maintained in igniting proximity to the trunk line 176. For example, and as shown in FIG. 12, the detonator cord 178 and the trunk line 176 are interfaced at the location 180 within the confines of the body member.

The charges are connected (See FIG. 3) through charge arming detonator cords 94 and 96 to the detonator trunk lines 82 and 84, respectively, such that the charges can be ignited from a location remote to the void subsequent to the placement of the charges at a preselected location. These trunk lines 86 and 88 are slidably received within the guides 82 and 84, respectively, during the placement operation. The guides serve to assist in preventing damage to the trunk lines and slidably receive the trunk lines therein such that the lines remain spaced from the explosive charge and void walls during placement. These guides 82 and 84 are proportioned to prevent the detonator cord connector device which makes the connection between the trunk line and the detonator cord from passing through the guides. In this connection, the detonator connectors 90 and 92 are both propelled along the trunk lines 86 and 88 by the perimeter of the guide openings on the face 20 of the body member. Thus, the guides 82 and 84 assist in preventing damage to the trunk lines and provide means for moving the sliding detonator cord connectors to the location of the charge placement.

Charges can be placed in accordance with the method of the present invention by placing a charge proximate the entry of a void, arming the charge and releasably engaging the armed charge with the body member 18 of the insert means. The charge can then be thrust or propelled into the void to a preselected location for positioning by manual operation of the driving means. More specifically, in the illustrated embodiment the driving means comprises extension arms 70 which can be forced into the void for moving the body member and charge contacted thereby to a preselected location for positioning.

Figure 2:
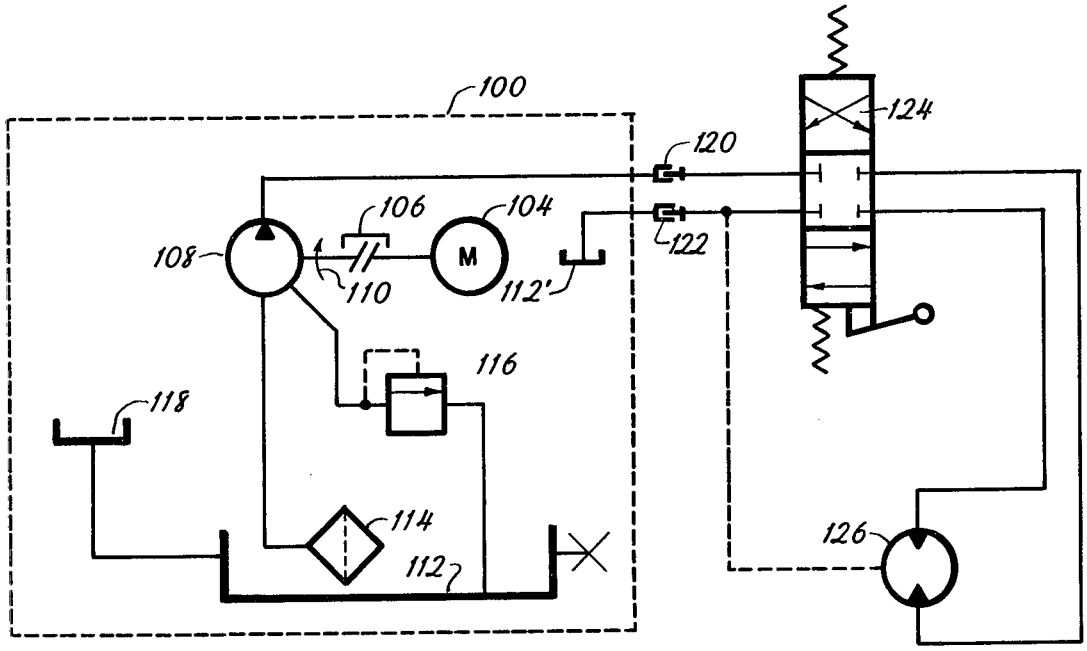
FIG. 2 is a systematic diagram of an exemplary hydraulic driving system for positioning the charges within the voids.

Another feature of the invention is to provide the driving means including a power source for driving the insert means as by imparting motion to the extension arms. The power source of the driving means in the embodiment illustrated in FIGS. 1 and 2 is derived from the motor vehicle 100 which is illustrated diagrammatically in FIG. 2. The vehicle 100 creates hydraulic pressure which is especially suited to the present application since the hydraulic pressure is efficient, easily routed, and will not ignite blasting caps or blasting powder as may be occasioned if electric or heat generating power sources are utilized. Referring now to the details of FIG. 2, the hydraulic energy generated by the vehicle motor 104 is connected through a coupling device 106 which can be a belt drive and serves to turn the hydraulic pump 108 in the direction of the arrow indicated at 110. Energization of the pump extracts hydraulic fluid from the tank 112 through filter 114 and pressurizes the fluid. The illustrated system also incorporates an overload relief valve 116 which returns unused pressurized fluid to the storage tank 112. A second storage tank 118 is connected in series to the regular storage tank 112 to enhance the storage capacity of the system. Pressure generated by the pump 108 is transported from the vehicle 110 to coupling device 120 to a lever operated 4-way directional control valve 124 which delivers the pressurized fluid to the reversable hydraulic motor 126 and then back through valve 124 and through coupling device 122 to tank 112'. In the free position of valve 124 all flow is blocked thereby halting motor 126. In the "in" and "out" positions of valve 124, the motor 126 is driven forward and backward, respectively. In this connection an operator can manually control both the speed and the direction of the hydraulic motor for purposes of propelling the extension arms inwardly or outwardly with respect to the longitudinal axis of the void.

Figure 9:
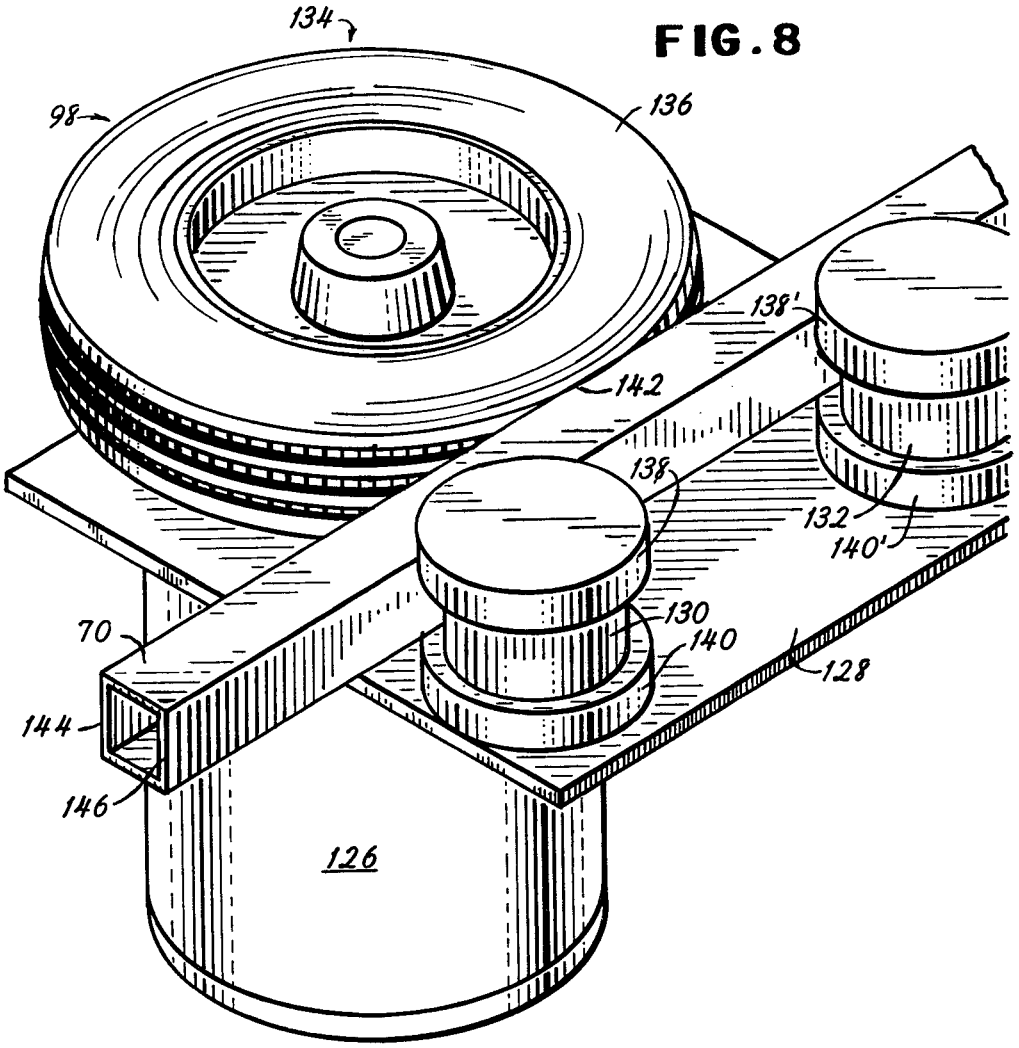
FIG. 9 is an isometric view of the coupling for driving the inserting extension sections.

The power source for the driving means is connected to the extension arms 70 through a coupling unit which directly applies the driving forces to the extension arms for propelling the extension arms along the length of the void for charge placement purposes. The illustrated coupling unit 134 in FIG. 9 is mounted on a support member 128 which is carried by the motor vehicle 100 in the illustrated embodiment. This support member carries the valve 124 at a location which is convenient for manual operation and also carries the hydraulic motor 126.

The driving means is connected to the extension arms in the illustrated embodiment through a coupling unit indicated generally at 134 in FIG. 9. This coupling unit 134 includes a pneumatically inflated drive wheel 136 having a high coefficient friction which is powered by the hydraulic motor 126. This driving wheel contacts the arm 70 at the location 142 and applies driving forces thereto. In this connection, idler wheels 130 and 132 define positioning lips 138, 140, and 138', 140', respectively, which limit the vertical movement of the extension arms 70. These idler wheels maintain the extension arms in contact with the pneumatic wheel 136 such that rotation of the drive wheel 136 imparts linear motion to the extension arms thereby driving the extension arm into or away from the void depending on the rotational direction with which the wheel is driven. As shown in FIG. 9, the extension arms are provided with a flat surface 144 upon which the driving wheel acts and a further flat surface 146 which is held within the confines of the idler wheels 130 and 132. This assures proper orientation of the charge 14 and the body member 18 which engages the charge. While the illustrated extension arms shown in FIG. 9 are square in cross-sectional outline, it will be recognized that other geometric outlines can be utilized.

Figure 8:
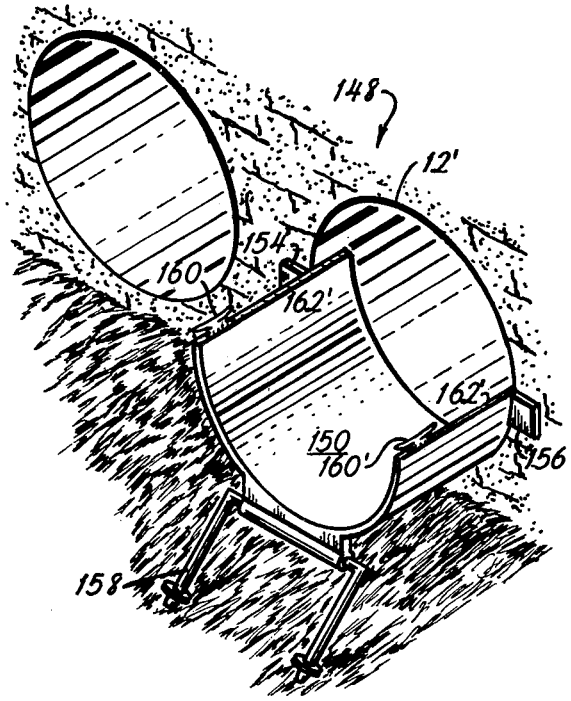
FIG. 8 is an isometric view of the entry of an auger hole having a charge loading platform constructed in accordance with various features of the invention.

In one embodiment of the charge inserting procedure, a loading platform is provided in 148 at FIG. 8. This platform includes a body member 150 which has cross-sectional configuration similar to the lower portion of the entry of the void 12'. The platform is opened at its upper portion and a section of the body member is inserted in the void entry such that the platform is properly aligned therewith. This body member receives and supports explosive charges in alignment with the longitudinal axis of the void preparatory to insertion. The opened upper portion of the loading platform provides ready access to the platform for charge placement as when heavy charges are postioned with a crane. Moreover, the platform serves as a location to field assemble charges at the void entry.

In order to secure the platform at a preselected location in alignment with the void, retaining cleats 154 and 156 serve to limit the extent. The leading portion of the body member can be inserted into the void. This leading end portion of the body is supported by the bottom or floor of the void and the opposite end portion of the body member is supported by an adjustable stand 158 which can be folded for storage and unfolded for positioning proximate the void entry. Accordingly, the platform 150 can be readily moved to adjacent void entries for subsequent charge loadings.

The loading platform 148 illustrated in FIG. 8 is also provided with means for securing the end portions of the detonator cords as illustrated by the cleats 160 and 160' mounted on the upper edges 162 and 162' respectively, of the body member 150. These cleats 160 and 160' in FIG. 8 are used to anchor detonator trunk lines 86 and 88 which pass through the charge insert means body member 18. In this connection, tension can be readily maintained on the detonator cords during charge placement operation.

The vehicle or truck 100 serves as a suitable mounting device for the driving means 98 and in this connection carries racks 166 and 166' attached thereto which provide storage areas for the extension arms 70. These racks are preferably mounted at a sufficiently low vertical position to prevent blocking the entrance 168 of the vehicle. Thus, the racks serve to support the extension arms and carry the coupling unit at a location which can be positioned proximate the entry of the void thereby reducing the labor involved in the charge placement operations.

From the foregoing detailed description it will be apparent that a method and apparatus for positioning individual explosive charges at preselected locations in substantially horizontal voids created by mining have been described and illustrated which incorporate various advantages over the prior art. For example, the method and apparatus enable positioning charges at preselected locations in voids such as auger holes from positions remote to such voids. Accordingly, the operator is not required to enter the voids and thereby avoids exposure to hazards concomitant such entry. Successive charges can be armed by means of a sliding detonator connection device which is affixed at a position remote to the void and propelled together with the charge to a preselected location therein. In one embodiment, the charge can be positioned proximate the entry of the void, and in aligment therewith on a loading platform prior to being thrust into the void. The depth at which the charges are inserted into the void can be determined by calibration means located on the extension arms or sections of the drive means. The orientation of the charge can be controlled by the drive means and as necessary or desired the charge may be secured to the inserting means in such a manner as to avoid contact between the charge and the void wall during the positioning process. In another embodiment of the invention the charge can be releasably secured to the body member of the inserting means such that it can be removed if desired.

While a preferred embodiment has been shown and described, it will be understood that there is no intent to limit the invention by such disclosure, but rather it is intended to cover all modifications and alternate constructions falling within the spirit and scope of the invention defined in the appended claims.

I claim:

1. A method of remotely positioning explosive charges at preselected locations in substantially horizontal voids created by mining in a vein of ore, each of said voids commencing at an entry proximate the cropping of said vein and continuing inwardly, said method comprising the steps of:

placing an initial charge proximate the entry of said void, arming said initial charge by attaching a blasting trunk line to said charge, releasably engaging said initial charge with a loading means, moving said initial armed charge along the length of said void until said charge is positioned at a first of said preselected locations within said void, depositing said initial charge with said blasting trunk line attached thereto at said first preselected location within said void, arming a further charge by slidably attaching a detonator cord of said further charge to said blasting trunk line, releasably engaging said further charge, and moving said further armed charge along the length of said void until said further charge is positioned at a further of said preselected locations within said void spaced from said initial charge, said further charge being positioned closer to said void entry than said initial charge.

2. A method of positioning a sufficient number of explosive charges at preselected locations in substantially horizontal voids created by mining into a vein of ore to enhance the efficiency of explosive blasts during reclamation of said ore, each of said voids commencing at an entry proximate the cropping of said vein and continuing inwardly therefrom, said method comprising the steps of:

arming an explosive charge exterior to said entry with a detonator having a branch detonator cord, including attaching said branch detonator cord to a trunk line detonator cord;

releasibly engaging said armed charge with a charge loading means positioned at said entry to said void;

moving said charge loading means into said void to a first selected location in said void using propelling means located exterior said entry to position said armed charge at said first selected location;

releasing said armed charge from said charge loading means at said first selected location in said void, and withdrawing said charge loading means from said void;

arming any further needed charge exterior to said entry with a detonator having a further branch detonator cord, and slidably engaging said further branch detonator cord in igniting proximity with said trunk line detonator cord;

releasably engaging said further armed charge with said charge loading means;

moving said charge loading means into said void to a further selected location in said void nearer said entry than said first selected location using said charge loading means; and releasing said further armed charge from said charge loading means at said further selected location in said void, and withdrawing said loading means from said void whereby said charges are positioned to achieve a desired blast pattern within said vein to achieve reclamation of said ore.

3. The method of claim 2 further comprising orienting said charge and any of said needed further charges within said void using positioners carried on said loading means to control orientation of said loading means during moving of said loading means to said selected locations within said void.

4. The method of claim 2 wherein said propelling means comprises a push rod releasably attached to said loading means and substantially aligned with said void, and drive means connected to said push rod to achieve reciprocative axial movement of said push rod to move said loading means into and out of said void.

5. The method of claim 4 wherein said push rod comprises axially-aligned releasably-attached portions, each portion carrying indicia indicating the length of said push rod to monitor the location of said loading means within said void.

6. The method of claim 2 wherein said loading means comprises: a platform to support one of said charges; releasable band means attached to said platform to hold said charge on said platform; guides on said platform for the passage of said trunk line detonator cord through said loading means; and clasp means on said platform for releasably attaching said band means to said platform.

7. The method of claim 3 wherein said positioners comprise elements exterior said loading means for engaging the wall of said void, and arms extending forward from said loading means to grasp sides of said charge.

8. The method of claim 2 wherein said branch detonator cord is slidably engaged with said trunk line detonator cord by providing a slide encircling said trunk line detonator cord, passing said branch detonator cord through said slide in igniting proximity to said trunk line detonator cord and fastening said branch detonator cord to said slide.

9. The method of claim 2 further comprising tensioning said trunk line detonator cord prior to slidably engaging said further branch detonator cord with said trunk line detonator cord.

10. The method of claim 4 wherein said drive means is a rotary wheel engaged with the surface of said push rod and means coupled to said rotary wheel to rotate said rotary wheel in either direction to achieve said reciprocative axial movement of said push rod.

* * * * *